US008154271B2

(12) United States Patent
Morishita

(10) Patent No.: US 8,154,271 B2
(45) Date of Patent: Apr. 10, 2012

(54) SEMICONDUCTOR INTEGRATED CIRCUIT DEVICE

(75) Inventor: Fukashi Morishita, Tokyo (JP)

(73) Assignee: Renesas Electronics Corporation, Kanagawa (JP)

( * ) Notice: Subject to any disclaimer, the term of this patent is extended or adjusted under 35 U.S.C. 154(b) by 0 days.

(21) Appl. No.: 13/115,327

(22) Filed: May 25, 2011

(65) Prior Publication Data

US 2011/0221419 A1 Sep. 15, 2011

Related U.S. Application Data

(63) Continuation of application No. 12/206,907, filed on Sep. 9, 2008, now Pat. No. 7,977,932.

(30) Foreign Application Priority Data

Sep. 26, 2007 (JP) ..... 2007-249525

(51) Int. Cl.
*G05F 3/16* (2006.01)

(52) U.S. Cl. ..... 323/313; 327/538; 327/543; 365/154; 365/201

(58) Field of Classification Search ..... 323/311–316, 323/907, 280, 281; 327/333, 316, 308, 530, 327/535, 537, 540, 541; 365/189.06, 189.11, 365/195, 200, 201, 225.7, 230.03, 233
See application file for complete search history.

(56) References Cited

U.S. PATENT DOCUMENTS 5,519,657 A * 5/1996 Arimoto ..... 365/200
5,694,364 A 12/1997 Morishita et al.
6,225,866 B1 * 5/2001 Kubota et al. ..... 330/295
6,246,221 B1 6/2001 Xi
6,341,098 B2 * 1/2002 Yamagata et al. ..... 365/226
6,434,078 B1 8/2002 Morishita
6,434,134 B1 8/2002 La Porta et al.
6,683,445 B2 * 1/2004 Park ..... 323/315
6,753,720 B2 6/2004 Kono et al.
6,777,920 B2 8/2004 Furutani et al.
6,791,308 B2 9/2004 Shim
7,288,926 B2 * 10/2007 Lee et al. ..... 323/314
7,368,896 B2 * 5/2008 Nagata et al. ..... 323/280
2005/0231180 A1 10/2005 Nagata et al.

FOREIGN PATENT DOCUMENTS

JP 2002-157031 5/2002

(Continued)

OTHER PUBLICATIONS

"Impact of Actively Body-bias Controlled (ABC) SOI SRAM by using Direct Body Contact Technology for Low-Voltage Application", Y. Hirano et al., IEEE international electron device meeting, 2003, session 2.4.

*Primary Examiner* — Rajnikant Patel
(74) *Attorney, Agent, or Firm* — Mattingly & Malur, PC

(57) ABSTRACT

The semiconductor integrated circuit device includes load circuits and internal voltage generators for generating internal source voltages for driving the load circuits. Each of the internal voltage generators includes a reference voltage generating circuit for generating reference voltages, and regulator circuits for generating the internal source voltages with reference to the reference voltages. The regulator circuit is formed over an SOI substrate and includes a preamplifier circuit for detecting and amplifying a difference between each of the internal source voltages and each of the reference voltages, a main amplifier circuit for amplifying the output of the preamplifier circuit and generating a control signal, and a driver circuit for generating the internal source voltage in response to the control signal. An input stage of the main amplifier circuit is configured by MOS transistors coupling the gates and bodies of the MOS transistors.

3 Claims, 16 Drawing Sheets

FOREIGN PATENT DOCUMENTS

| | | |
|---|---|---|
| JP | 2002-258956 | 9/2002 |
| JP | 2003-283321 | 10/2003 |
| JP | 2005-071067 | 3/2005 |
| JP | 2005-202781 | 7/2005 |
| JP | 2005-316959 | 11/2005 |

* cited by examiner

SEMICONDUCTOR INTEGRATED CIRCUIT DEVICE

CROSS-REFERENCE TO RELATED APPLICATIONS

This application is a continuation application of U.S. Ser. No. 12/206,907, filed on Sep. 9, 2008, the entire disclosure of which is hereby incorporated by reference.

The disclosure of Japanese Patent Application No. 2007-249525 filed on Sep. 26, 2007 including the specification, drawings and abstract is incorporated herein by reference in its entirety.

BACKGROUND OF THE INVENTION

The present invention relates to a semiconductor integrated circuit device, and particularly to an internal voltage generator which supplies internal source voltage to load circuits such as a memory circuit, a logic circuit, etc.

An internal voltage generator employed in a semiconductor integrated circuit device needs a contrivance on such a circuit that a constant interval source voltage is generated irrespective of a variation in load current.

In a voltage regulator disclosed in, for example, Japanese Unexamined Patent Publication No. 2005-202781 (Patent Document 1), a main group is formed by a first amplifier, a second amplifier, P-MOSFET and a phase compensating capacitor. A sub group is formed by a third amplifier, a dc-component cutting capacitor and P-MOSFET. The sub group based on the third amplifier is capable of reducing the amount of variation in output voltage even though a load current rises at high speed. The second amplifier is used when it is desired to further increase the gain of a signal amplified by the first amplifier.

A voltage generator or generating circuit disclosed in Japanese Unexamined Patent Publication No. 2005-71067 (Patent Document 2) includes an error amplifier having differential amplifier circuits of two stages coupled in tandem, and a control circuit having cascade-coupled inverter circuits. The control circuit performs control as to driving of both differential amplifier circuits or driving of only the differential amplifier circuit of subsequent stage according to a high-low relationship between a gate voltage of a P channel MOSFET for a driver and an operational threshold voltage of each inverter circuit.

Thus, since the gain of the error amplifier becomes high by driving of both the differential amplifier circuits where the operating current of each internal circuit is large, the response to a change in operating state of the internal circuit can be enhanced, and the supply capacity of current to the internal circuit can be improved. Since the differential amplifier circuits are not driven when the operating current of the internal circuit is small, the amount of current consumption in the error amplifier can be suppressed as compared with the case in which the differential amplifier circuits of two stages are always driven.

A constant voltage circuit disclosed in Japanese Unexamined Patent Publication No. 2005-316959 (Patent Document 3) has a first error amplifier made high in dc gain, and a second error amplifier having a fast response characteristic. Control on the operation of an output voltage control transistor is performed with respect to a variation in output voltage by means of the first and second error amplifiers. The first error amplifier is designed to reduce the drain current of an NMOS transistor that forms a constant current source, as small as possible. The second error amplifier is designed to make as large as possible the drain current of the NMOS transistor that forms the constant current source.

SUMMARY OF THE INVENTION

Even when current consumption has increased abruptly in each internal circuit, an internal voltage generator for an integrated circuit needs to keep a constant internal source voltage by supplying a large current to the internal circuit in response to its increase steeply. In recent years, the fast response and high drivability of the circuit must be realized from the following circumstances to enable adaptation to stricter conditions.

Firstly, there is cited a viewpoint that in the leading-edge semiconductor process, the ratio of a threshold voltage of each transistor in a source voltage rises as micro-fabrication progresses. Taking a 65 nm process for example, the sum of threshold voltages of PMOS and NMOS becomes greater than or equal to 0.8V under the strictest conditions with respect to an internal source voltage 1.0V. Therefore, an internal source voltage higher in precision than conventional is required.

Secondly, there is cited a viewpoint that a microprocessor, a motion picture processing function, a memory and the like have heretofore been respectively configured in discrete chips and wired over a system board, whereas an SoC (System On Chip) which integrates those functions into the same chip has been used in recent years. The SoC is used for reasons of miniaturization of equipment, simplification of wiring, speeding-up, low power consumption and the like.

In this respect, the conventional method of generating and supplying the internal source voltages by the discrete regulator chips is not capable of satisfying the accuracy of each internal source voltage required for the SoC. This is because it is subjected to a voltage drop due to the resistance of an internal source or power wiring from the regulator chip to the SoC, and the influence of noise due to an inductance component of the internal power wiring.

Thus, there is a need to on-chip mount the internal voltage generator in the SoC. It is necessary to make the internal voltage generator smaller in size than conventional in such a manner that it can be mounted on an on-chip basis. Further, there is a need to reduce an external source voltage supplied to the internal voltage generator to the same degree as the internal source voltage for the purpose of low power consumption of the SoC.

In terms of such high precision, circuit miniaturization and voltage reduction, the technologies disclosed in the prior art documents referred to above are not enough therefor.

Thus, an object of the present invention is to provide a semiconductor integrated circuit device equipped with a high-precision internal voltage generator. A more specific object of the present invention is to provide an internal voltage generator which can fast respond to a variation in load current and supply a sufficient drive current in such a manner that a stable internal source voltage can be generated even under a low voltage. A further object of the present invention is to realize the functions of those in a preferably simple configuration so as to make circuit miniaturization possible.

The present invention provides a semiconductor integrated circuit device comprising load circuits, and internal voltage generators for generating internal source voltages for driving the load circuits. Each of the internal voltage generators includes a reference voltage generating circuit for generating reference voltages, and regulator circuits for generating the internal source voltages with reference to the reference voltages. Here, the regulator circuit includes a preamplifier circuit for detecting and amplifying a difference between each of the internal source voltages and each of the reference voltages, a clamp circuit for limiting the amplitude of an output of the preamplifier circuit, a main amplifier circuit for amplifying the output of the preamplifier circuit limited by the clamp circuit and generating a control signal, and a driver circuit for generating the internal source voltage in response to the control signal.

According to the present invention, an error between a reference voltage and a feed-backed internal source voltage is amplified in two stages of a preamplifier circuit and a main amplifier circuit. Thus, a sufficient drive current can be supplied promptly and with a high degree of accuracy according to a variation in load current. Further, even when the load current varies abruptly, a stable operation can be realized by a simple circuit configuration wherein a clamp circuit for limiting the amplitude of an output of the preamplifier circuit is provided.

BRIEF DESCRIPTION OF THE DRAWINGS

FIG. 14 is front-viewed;

FIG. 14 is side-viewed;

DETAILED DESCRIPTION OF THE PREFERRED EMBODIMENTS

Figure 1:
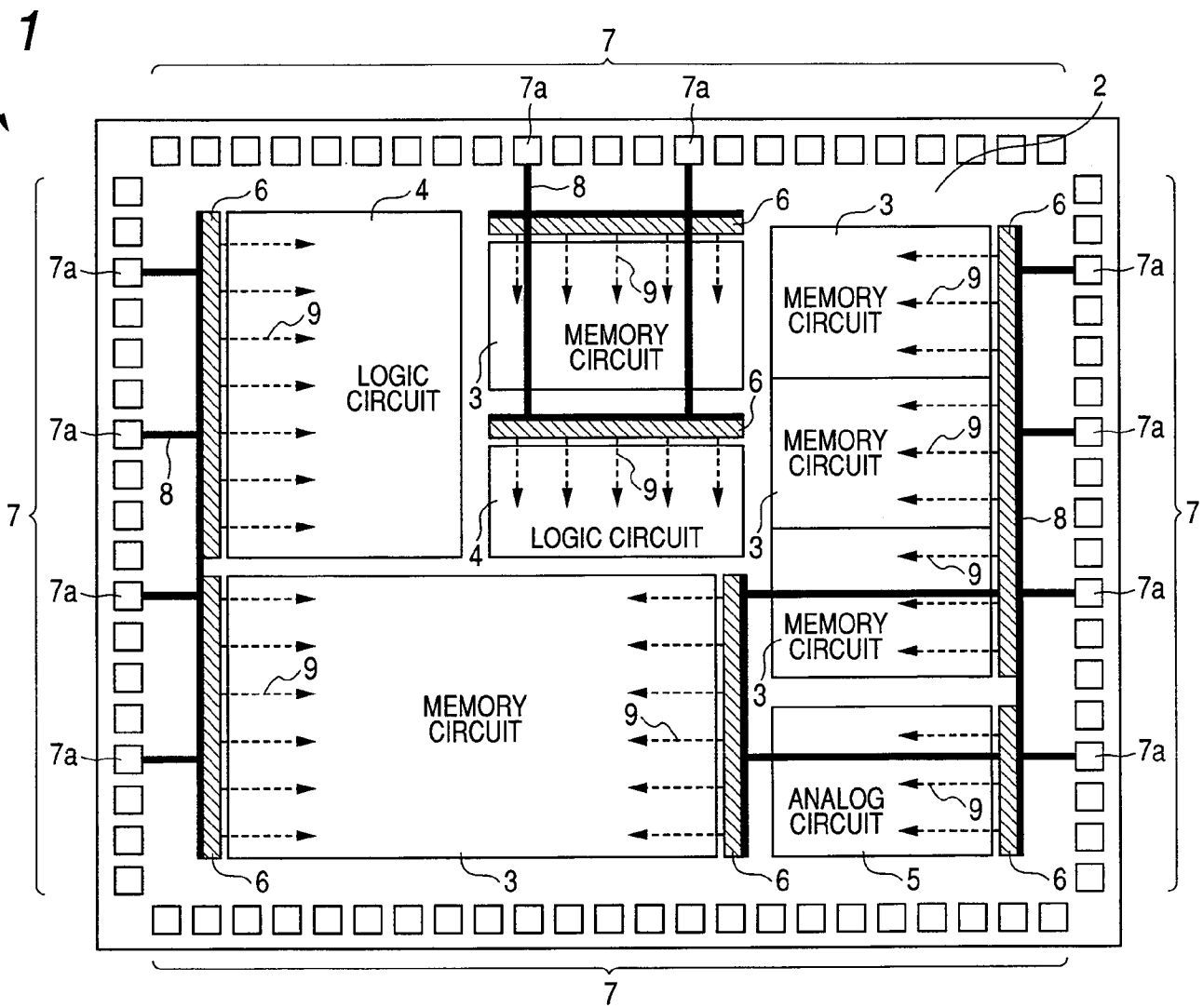
FIG. 1 is a plan view showing a schematic configuration of a semiconductor integrated circuit device 1 as a first preferred embodiment of the present invention.

Preferred embodiments of the present invention will hereinafter be explained in detail with reference to the accompanying drawings. Incidentally, the same reference numerals are attached to the same or corresponding parts and their explanations will not be repeated.

First Preferred Embodiment

FIG. 1 is a plan view showing a schematic configuration of a semiconductor integrated circuit device 1 as a first embodiment of the present invention.

Referring to FIG. 1, the semiconductor integrated circuit device 1 includes load circuits such as memory circuits 3, logic circuits 4 and an analog circuit 5, etc., and internal voltage generating circuits or generators 6 all of which are formed on a main surface of a semiconductor substrate 2. Bonding pads 7 are provided at peripheral edge portions lying on the main surface of the semiconductor substrate 2.

Each of the logic circuits 4 includes various circuits corresponding to applications such as image processing, network processing, etc. in addition to a CPU (Central Processing Unit). The analog circuit 5 includes circuits such as an analog-to-digital converter, a digital-to-analog converter, an interface circuit, PLL/DLL (Phase/Delay Locked Loop), etc. Each of the memory circuits 3 is disposed adjacent to each logic circuit 4 and holds data supplied from its corresponding logic circuit 4 or the like. Further, the memory circuit 3 outputs the held data to the logic circuit 4 and the like.

The internal voltage generators 6 are respectively disposed adjacent to the respective load circuits 3, 4 and 5 and generate internal source voltages necessary to drive the load circuits 3, 4 and 5. The generated internal source voltages are supplied to the respective load circuits 3, 4 and 5 via power wirings 9 (indicated by the broken-line arrows in FIG. 1). An external source voltage VDD necessary to drive the internal voltage generator 6 is supplied to the internal voltage generator 6 from bonding pads 7*a* via power wirings 8 (indicated by thick solid lines in FIG. 1).

Figure 2:
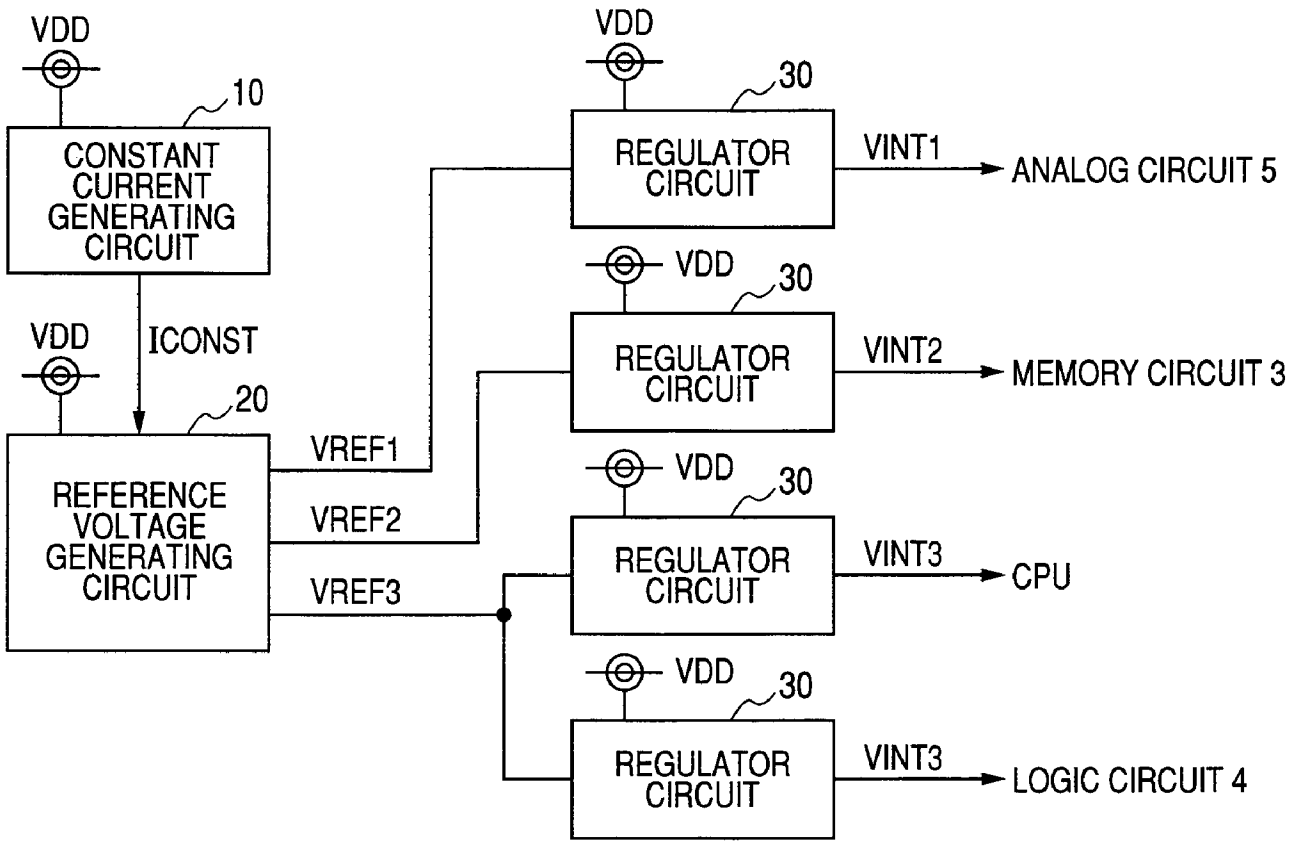
FIG. 2 is a block diagram illustrating a configuration of an internal voltage generator 6 shown in FIG. 1.

FIG. 2 is a block diagram showing a configuration of the internal voltage generator 6 shown in FIG. 1. Referring to FIG. 2, the internal voltage generator 6 includes a constant current generating circuit 10, a reference voltage generating circuit 20 and a plurality of regulator circuits 30. The constant current generating circuit 10 and the reference voltage generating circuit 20 are provided at least one by one in the semiconductor integrated circuit device 1 according to the layout of an integrated circuit. The regulator circuits 30 are provided in the semiconductor integrated circuit device 1 in plural form to supply internal source voltages corresponding to the load circuits 3, 4 and 5.

The constant current generating circuit 10 is driven by the external source voltage VDD and generates a constant current i that does not depend on a variation in the external source voltage VDD. The constant current generating circuit 10 outputs an intermediate voltage ICONST to the reference voltage generating circuit 20.

The reference voltage generating circuit 20 copies the current i generated at the constant current generating circuit 10 by a current mirror as will be described later. The copied current i is converted into a plurality of reference voltages VREF1, VREF2 and VREF3. The reference voltages VREF1, VREF2 and VREF3 respectively become values targeted for the internal source voltages VINT1, VINT2 and VINT3 supplied to the analog circuit 5, the memory circuit 3, and the logic circuit 4 such as the CPU.

A uniform internal source voltage has heretofore been supplied to the load circuits 3, 4 and 5. On the other hand, the internal voltage generator 6 for SoC generates the internal source voltages VINT1, VINT2 and VINT3 suitable for the load circuits 3, 4 and 5 and supplies the same to the load circuits 3, 4 and 5.

Described specifically, since it is desired to reduce power consumption as much as possible in the logic circuit 4 such as the CPU, the lowest internal source voltage VINT3 is used. The internal source voltage VINT3 is of, for example, 1.0V. In order to take an operating margin high, the memory circuit 3 is driven by the high internal source voltage VINT2 so long as the reliability of an oxide film for each MOS transistor is allowed. The internal source voltage VINT2 is of, for example, 1.05V. The analog circuit 5 needs not dare to reduce its operating voltage. The internal source voltage VINT1 used for the analog circuit 5 is set to, for example, 1.2V. The external source voltage VDD for driving each internal voltage generator 6 is set to, for example, 1.5V, allowing for a margin from these internal source voltages VINT1 through VINT3.

The regulator circuits 30 shown in FIG. 2 respectively output the internal source voltages VINT1, VINT2 and VINT3 by feedback control such that they become equal to their corresponding target reference voltages VREF1, VREF2 and VREF3. When current consumption of the load circuits 3, 4 and 5 increase suddenly, the regulator circuits 30 respectively supply large currents to the load circuits 3, 4 and 5 in response to changes in the current consumption steeply. Thus, drops in the internal source voltages VINT1, VINT2 and VINT3 are controlled so as to be reduced as low as possible. Incidentally, when the reference voltages VREF1, VREF2 and VREF3 are taken as a generic name or indicate an unspecified one, they are described as a reference voltage VREF. Similarly, when the internal source voltages VINT1, VINT2 and VINT3 are taken as a generic name or indicate an unspecified one, they are described as an internal source voltage VINT.

Figure 3:
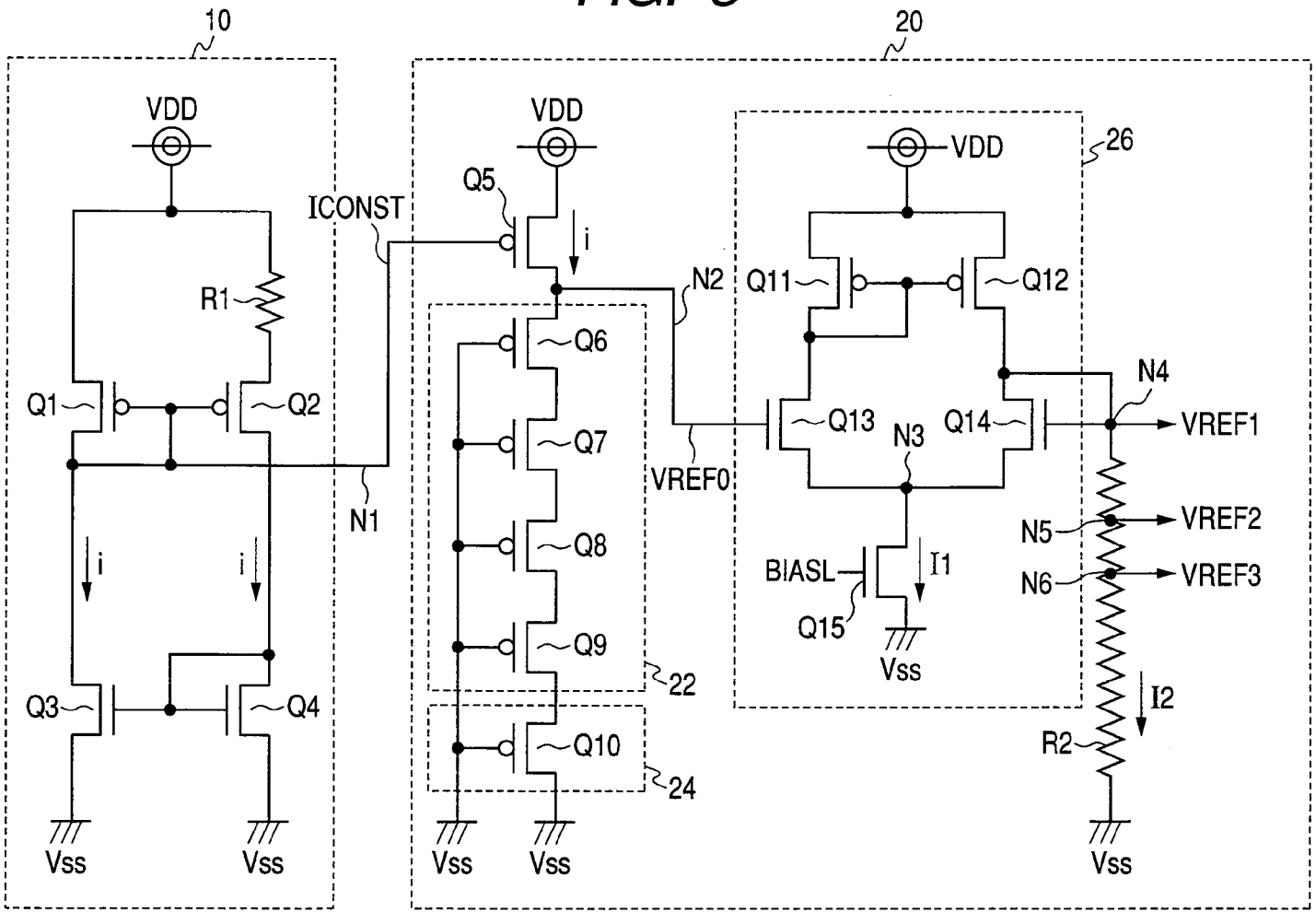
FIG. 3 is a circuit diagram showing a specific configuration example illustrative of a constant current generating circuit 10 and a reference voltage generating circuit 20 both shown in FIG. 2.

FIG. 3 is a circuit diagram showing a specific configuration example illustrative of the constant current generating circuit 10 and the reference voltage generating circuit 20 shown in FIG. 2.

Referring to FIG. 3, the constant current generating circuit 10 includes a resistive element R1, P channel MOS transistors Q1 and Q2, and N channel MOS transistors Q3 and Q4. Their coupling will first be explained.

The MOS transistors Q1 and Q3 shown in FIG. 3 are coupled in series between a source node VDD and a ground node Vss in this order. The resistive element R1 and the MOS transistors Q2 and Q4 are also coupled in series between the source node VDD and the ground node Vss in this order. The gate and drain of the MOS transistor Q1 and the gate of the MOS transistor Q2 are respectively coupled to a node N1. The gates of the MOS transistors Q3 and Q4 are both coupled to the gate of the MOS transistor Q4.

The operation of the constant current generating circuit 10 will next be described. In FIG. 3, the MOS transistors Q3 and Q4 form or configure a current mirror circuit. Thus, when the MOS transistors Q3 and Q4 are equal to each other in form and characteristic, a current i that flows through the MOS transistors Q1 and Q3 and a current i that flows through the resistive element R1 and the MOS transistors Q2 and Q4 are equal to each other.

The current i is equal to a value obtained by dividing a voltage VR1 developed across the resistive element R1 by the resistance value of the resistive element R1. The voltage VR1 is equal to a value obtained by subtracting a gate-to-source voltage of the MOS transistor Q2 from a gate-to-source voltage of the MOS transistor Q1. As a result, the current i becomes a constant current that depends on the channel widths and lengths of the MOS transistors Q1 and Q2, the resistance value of the resistive element R1, their gate capacities and carrier mobility. Accordingly, the current i is determined irrespective of the external source voltage VDD.

The reference voltage generating circuit 20 shown in FIG. 3 includes a P channel MOS transistor Q5 for copying a current i by a current mirror, a plurality of P channel MOS transistors Q6 through Q10 coupled in tandem, a current amplifying buffer circuit 26 and a resistive element R2. Here, the current amplifying buffer circuit 26 includes P channel MOS transistors Q11 and Q12 and N channel MOS transistors Q13 through Q15. Their coupling will first be explained.

The MOS transistor Q5 of the reference voltage generating circuit 20 is coupled between a source node VDD and a node N2. The gate of the MOS transistor Q5 is coupled to the node N1. The MOS transistors Q6 through Q10 are coupled in series between the node N2 and the ground node Vss in this order. The gates of the MOS transistors Q6 through Q10 are coupled to the ground node Vss.

The MOS transistors Q11 and Q13 that configure the current amplifying buffer circuit 26 are coupled between the source node VDD and a node N3 in this order. Similarly, the MOS transistors Q12 and Q14 are also coupled between the source node VDD and the node N3 in this order. The MOS transistor Q15 is provided between the node N3 and the ground node Vss.

Here, the gates of the MOS transistors Q11 and Q12 are both coupled to the drain of the MOS transistor Q11. The gate of the MOS transistor Q13 is coupled to the node N2. The gate and drain of the MOS transistor Q14 are coupled to a node N4. The gate of the MOS transistor Q15 is supplied with a bias voltage BIASL.

The resistive element R2 is coupled between the node N4 and the ground node Vss. A reference voltage VREF1 is taken out from the node N4. The voltage applied across the resistive element R2 is divided to take out reference voltages VREF2 and VREF3 from nodes N5 and N6 provided in the resistive elements R2.

The operation of the reference voltage generating circuit 20 having such a configuration will next be described. The MOS transistor Q5 shown in FIG. 3 forms a current mirror circuit together with the MOS transistor Q1. Thus, when the MOS transistor Q5 is equal to the MOS transistor Q1 in shape and characteristic, a constant current equal to the current i flowing through the MOS transistor Q1 flows through the MOS transistor Q5.

In response to the constant current i, the cascade-coupled MOS transistors Q6 through Q10 perform current-voltage conversion to generate a constant reference voltage VREF0. That is, the MOS transistors Q6 through Q9 are configured by long channel transistors and function as a resistive element 22 having a resistance value R as a whole. The diode-coupled MOS transistor Q10 functions as a diode element 24 having a threshold voltage Vth. Thus, the reference voltage VREF0 is determined in accordance with $VREF0=i\cdot R+Vth$ using these current i, resistance value R and threshold voltage Vth. Incidentally, the dependence of the current i generated by the constant current generating circuit 10 on the temperature is adjusted by the resistive element 22 and the diode element 24.

Thus, the reference voltage VREF0 becomes an approximately constant value that does not depend on the temperature.

The current amplifying buffer circuit 26 is of a voltage follower circuit in which an inversion input terminal of a differential amplifier circuit and an output terminal thereof are directly coupled to each other. Described specifically, the MOS transistors Q13 and Q14 configure a differential pair of an input stage of the differential amplifier circuit, the MOS transistors Q11 and Q12 configure a current mirror circuit, and the MOS transistor Q15 configures a current source. The gate of the MOS transistor Q13 corresponds to a positive-phase input terminal (non-inversion input terminal), the gate of the MOS transistor Q14 corresponds to a reverse-phase or antiphase input terminal (inversion input terminal), and the drain of the MOS transistor Q14 corresponds to an output terminal. The gate and drain of the MOS transistor Q14 are coupled to each other. The voltage follower circuit functions as an impedance converter circuit which converts a high input resistance to a low output resistance.

Thereafter, a plurality of reference voltages VREF1, VREF2 and VREF3 required are obtained by dividing the output of the current amplifying buffer circuit 26 by the resistive element R2. The so-obtained reference voltages VREF1, VREF2 and VREF3 are respectively supplied to the regulator circuits 30. Here, a current I1 that flows through the MOS transistor Q15 is set to be sufficiently greater than a current I2 that flows through the resistive element R2. Further, the current I2 becomes larger than the current i generated by the constant current generating circuit 10.

Figure 4:
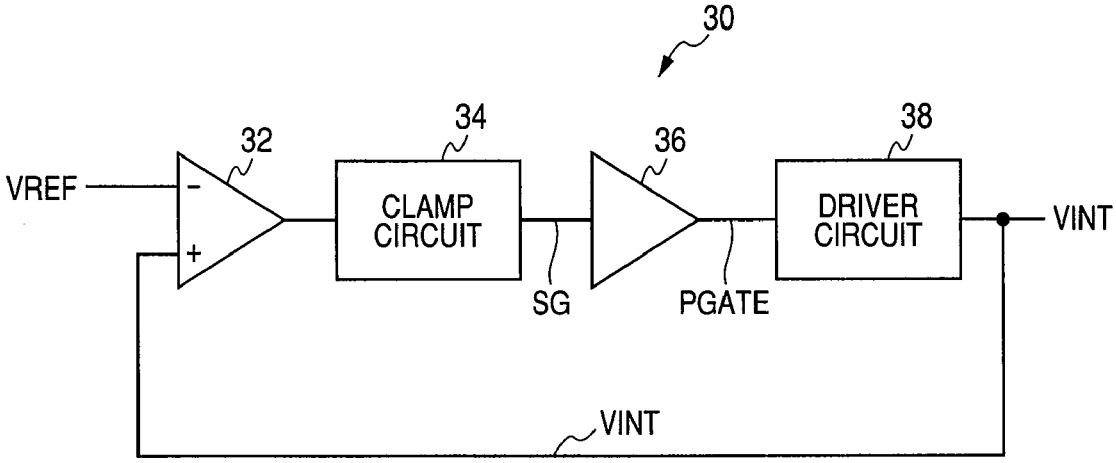
FIG. 4 is a block diagram showing a configuration of a regulator circuit 30 shown in FIG. 2.

FIG. 4 is a block diagram showing a configuration of the regulator circuit 30 shown in FIG. 2. Referring to FIG. 4, the regulator circuit 30 includes a preamplifier circuit 32, a clamp circuit 34, a main amplifier circuit 36 and a driver circuit 38.

The preamplifier circuit 32 shown in FIG. 4 functions as a differential amplifier circuit for detecting and amplifying the difference between an internal source voltage VINT and a reference voltage VREF. The clamp circuit 34 limits the amplitude of an output of the preamplifier circuit 32. The main amplifier circuit 36 outputs a control signal PGATE for controlling the output of the driver circuit 38, in response to the output signal SG whose amplitude is limited by the clamp circuit 34. The driver circuit 38 outputs the internal source voltage VINT in response to the control signal PGATE.

A first feature of the regulator circuit 30 according to such a first preferred embodiment resides in that two-stage signal amplification is conducted using the preamplifier circuit 32 and the main amplifier circuit 36. Consider as a comparative example, for instance, where the differential amplifier circuit of one stage amplifies the difference between the internal source voltage VINT and the reference voltage VREF and the driver circuit 38 is thereby driven. Assume that the differential amplifier circuit has an amplification factor of a voltage gain 30 dB or so (about 30 times). Assume that 600 mV is required as the voltage amplitude of the control signal PGATE to drive the driver circuit 38 sufficiently. In this case, 20 mV is required as the difference between the internal source voltage VINT and the reference voltage VREF inputted to the differential amplifier circuit. In other words, it is not possible to operate the driver circuit 38 sufficiently unless a reduction in the internal source voltage VINT of 20 mV occurs. Thus, in the first preferred embodiment, the amplifying circuits are configured in two stages to increase the voltage gain, thereby allowing the driver circuit 38 to operate sufficiently even when the difference between the internal source voltage VINT and the reference voltage VREF is small. Preferably, the gain of the preamplifier circuit 32 is set larger than that of the main amplifier circuit 36. It is thus possible to increase sensitivity to the difference between the internal source voltage VINT and the reference voltage VREF.

A second feature of the regulator circuit 30 resides in that the clamp circuit 34 is provided between the preamplifier circuit 32 and the main amplifier circuit 36. When the difference between the internal source voltage VINT and the reference voltage VREF inputted to the preamplifier circuit 32 is excessively large, an output that exceeds the input range of the main amplifier circuit 36 of the next stage is obtained as the output of the preamplifier circuit 32. When this so-called range-over state is reached, the main amplifier circuit 36 is not operated normally and hence the regulator circuit 30 oscillates. Thus, in the first preferred embodiment, the clamp circuit 34 is provided on the output side of the preamplifier circuit 32 to limit the amplitude of the signal SG inputted to the main amplifier circuit 36.

Incidentally, it is assumed in FIG. 4 that a P channel MOS transistor is used as the driver circuit 38 and the control signal PGATE is inputted to its gate. In this case, the internal source voltage VINT is inputted to its corresponding positive-phase input terminal of the preamplifier circuit 32, and the reference voltage VREF is inputted to its corresponding antiphase or negative-phase input terminal thereof. Thus, since the output of the preamplifier circuit 32 decreases when the internal source voltage VINT is reduced with an increase in the current consumption of each load circuit, the internal source voltage VINT outputted from the drive circuit 38 increases. As a result, the internal source voltage VINT is kept constant. When an N channel MOS transistor is used for the driver circuit 38, the internal source voltage VINT is inputted to the antiphase input terminal of the preamplifier circuit 32, and the reference voltage VREF is inputted to the positive-phase input terminal of the preamplifier circuit 32.

Figure 5:
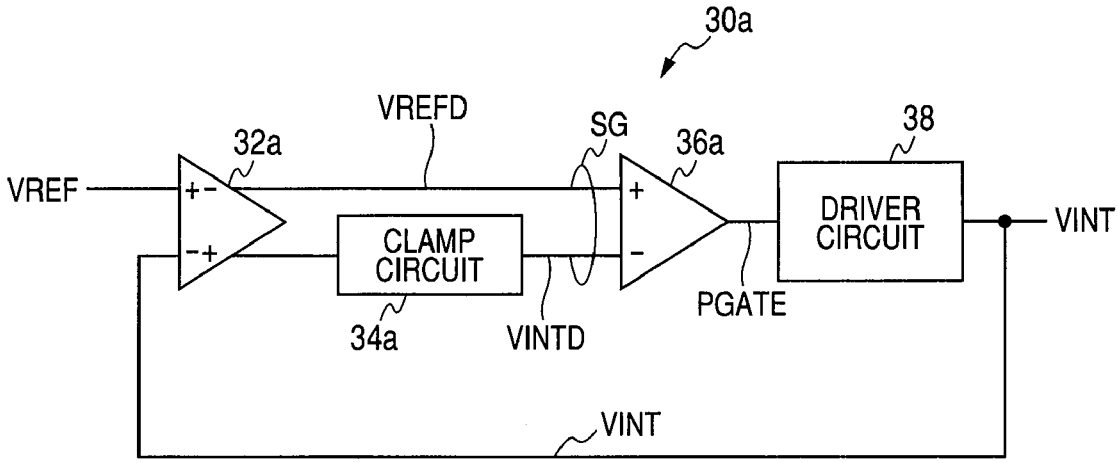
FIG. 5 is a block diagram depicting a configuration of a regulator circuit 30*a* as a modification of FIG. 4.

FIG. 5 is a block diagram showing a configuration of a regulator circuit 30*a* as a modification of FIG. 4. In the regulator circuit 30*a* shown in FIG. 5, a preamplifier circuit 32*a* is configured by a fully differential amplifier circuit having a pair of differential output terminals in place of the preamplifier circuit 32 shown in FIG. 4. Further, in the regular circuit 30*a* shown in FIG. 5, a main amplifier circuit 36*a* is configured by a differential amplifier circuit having a pair of differential input terminals in place of the main amplifier circuit 36 shown in FIG. 4. In the regulator circuit 30*a* shown in FIG. 5, a clamp circuit 34*a* is provided such that at least the amplitude of an output antiphase to an internal source voltage VINT is limited. Thus, a signal SG outputted from the preamplifier circuit 32*a* shown in FIG. 5 has a signal VREFD in phase with the internal source voltage VINT and the antiphase signal VINTD whose amplitude is limited by the clamp circuit 34*a*. When a P channel MOS transistor is used for a driver circuit 38, the signal VREFD in phase with the internal source voltage VINT is supplied to its corresponding positive-phase input terminal of the main amplifier circuit 36*a*, and the antiphase signal VINTD is inputted to its corresponding antiphase input terminal of the main amplifier circuit 36*a*, as shown in FIG. 5. When an N channel MOS transistor is used for the driver circuit 38, the signal VREFD in phase with the internal source voltage VINT is supplied to the antiphase input terminal of the main amplifier circuit 36*a*, and the antiphase signal VINTD is inputted to the positive-phase input terminal of the main amplifier circuit 36*a*, contrary to FIG. 5.

The regulator circuit 30*a* shown in FIG. 5 is also operated in a manner similar to the regulator circuit 30 shown in FIG. 4. Namely, when the internal source voltage VINT is reduced with an increase in current consumption of each load circuit, the output voltage of the antiphase output signal VINTD of the preamplifier circuit 32*a* increases. When, at this time, the reduction in the internal source voltage VINT is abrupt, the increase in the voltage of the antiphase signal VINTD is limited by the clamp circuit 34*a*. Since the output voltage of a control signal PGATE outputted from the main amplifier circuit 36*a* is reduced with the increase in the output signal VINTD, the internal source voltage VINT supplied from the driver circuit 38 increases. Thus, the internal source voltage VINT is kept constant.

Figure 6:
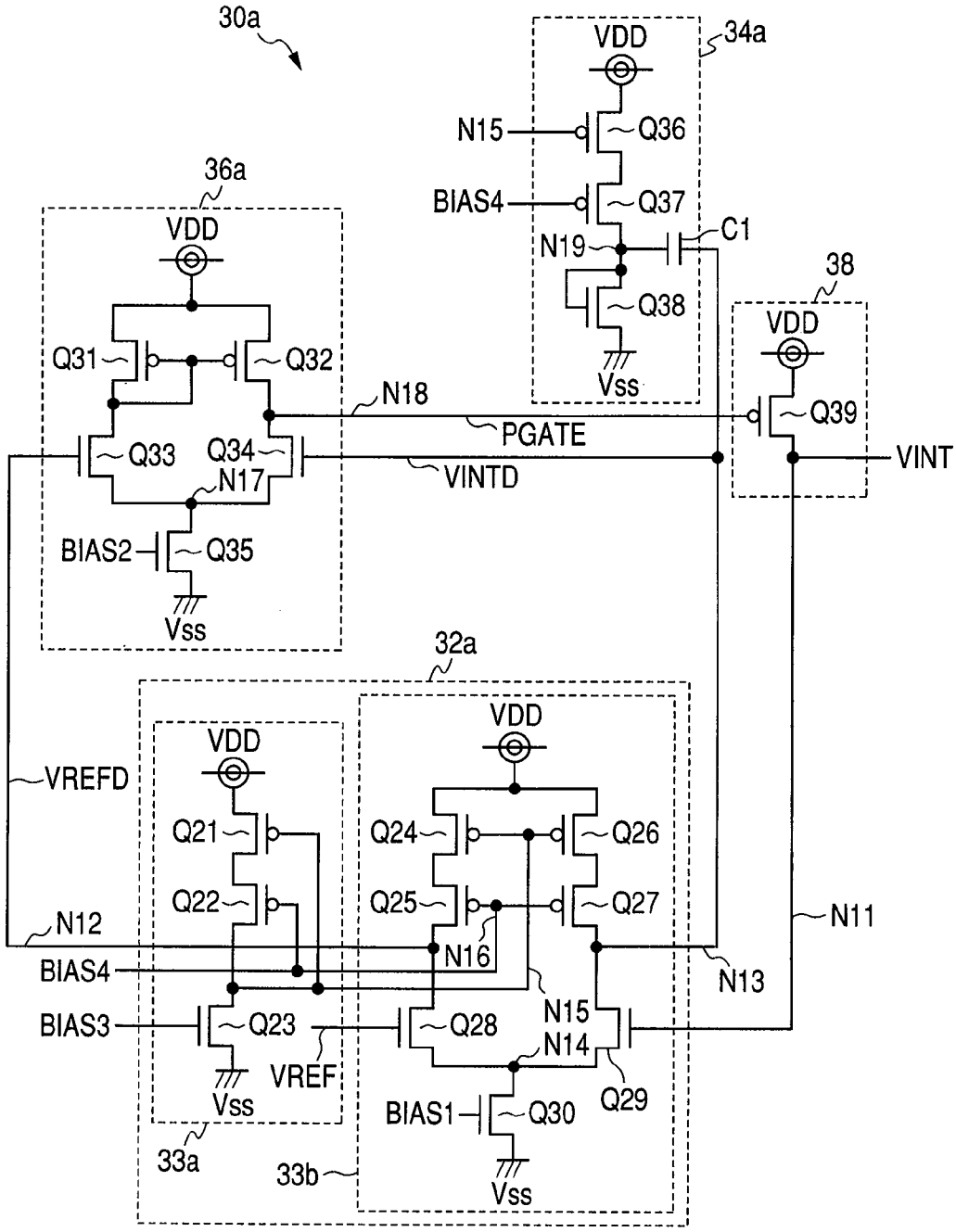
FIG. 6 is a circuit diagram showing a detailed configuration of the regulator circuit 30*a* shown in FIG. 5.

FIG. 6 is a circuit diagram showing a detailed configuration of the regulator circuit 30*a* shown in FIG. 5. Referring to FIG. 6, the preamplifier circuit 32*a* includes a differential amplifying section 33*b* for detecting and amplifying a difference between a reference voltage VREF and an internal source voltage VINT, and a constant current source section 33*a* for supplying a constant current to each load transistor of the differential amplifying section 33*b*.

Of these, the differential amplifying section 33*b* has N channel MOS transistors Q28 and Q29 that configure a differential pair, P channel MOS transistors Q24 through Q27 that configure low-voltage cascode-coupled load transistors, and an N channel MOS transistor Q30 that configure a constant current source.

As to the coupling of these MOS transistors Q24 through Q30, the MOS transistors Q24, Q25 and Q28 are coupled in series between a source node VDD and a node N14 in this order. Similarly, the MOS transistors Q26, Q27 and Q29 are coupled in series between the source node VDD and the node N14 in this order. The MOS transistor Q30 is coupled between the node N14 and a ground node Vss.

Here, the gates of the MOS transistors Q24 and Q26 are both coupled to a node N15. The gates of the MOS transistors Q25 and Q27 are both coupled to a node N16. The gate of the MOS transistor Q28 is supplied with the reference voltage VREF and its drain is coupled to a node N12. A signal VREFD is outputted from the MOS transistor Q28. The gate of the MOS transistor Q29 is coupled to a node N11, which is supplied with the internal source voltage VINT, and its drain is coupled to a node N13. A signal VINTD is outputted from the drain of the MOS transistor Q29. The gate of the MOS transistor Q30 is supplied with a bias voltage BIAS1, thereby defining the current that flows through the MOS transistor Q30.

The constant current source section 33*a* shown in FIG. 6 has P channel MOS transistors Q21 and Q22 coupled in series between the source node VDD and the node N15, and an N channel MOS transistor Q23 coupled between the node N15 and the ground node Vss. Here, the gate of the MOS transistor Q21 is coupled to the node N15 and the gate of the MOS transistor Q22 is coupled to the node N16. A bias voltage BIAS4 is supplied to the node N16. The bias voltage BIAS4 is set to, preferably, a lower value in a range in which the corresponding MOS transistor operates in a saturated region. The gate of the MOS transistor Q23 is supplied with a bias voltage BIAS3 thereby to define the current that flows through the MOS transistors Q21 through Q23.

Since the voltage gain is enhanced in the preamplifier circuit 32*a* shown in FIG. 6 by cascode-coupling of the P channel MOS transistors Q24 through Q27, a high-sensitive differential amplifier circuit is realized. As a result of simulation, the preamplifier circuit 32*a* corresponding to a cascode-type differential amplifier circuit can ensure a voltage gain 46 dB (about 200 times). Thus, assuming that, for example, 20 mV is required as a potential difference of a differential input of the main amplifier circuit 36*a* to drive the driver circuit 38, the driver circuit 38 can be driven if a potential difference (difference between the reference voltage VREF and the internal source voltage VINT) of a differential input of the preamplifier circuit 32*a* is 0.1 mV. With the provision of the preamplifier circuit 32*a* in this way, the regulator circuit 30*a* can promptly adapt to a change in the difference between the reference voltage VREF and the internal source voltage VINT even though the change is slight.

The main amplifier circuit 36*a* shown in FIG. 6 includes N channel MOS transistors Q33 and Q34 that configure a differential pair, P channel MOS transistors Q31 and Q32 that form a current mirror circuit, and an N channel MOS transistor Q35 that configures a constant current source. The MOS transistors Q31 and Q33 are coupled in series between the source node VDD and a node N17 in this order. Similarly, the MOS transistors Q32 and Q34 are coupled in series between the source node VDD and the node N17 in this order. The MOS transistor Q35 is coupled between the node N17 and the ground node Vss.

Here, the gates of the MOS transistors Q31 and Q32 are both coupled to the drain of the MSO transistor Q31. The gate of the MOS transistor Q33 is coupled to the node N12. The output signal VREFD of the preamplifier circuit 32*a* is inputted to the gate of the MOS transistor Q33. The gate of the MOS transistor Q34 is coupled to the node N13 and its drain is coupled to a node N18. The output signal VINTD of the preamplifier circuit 32*a* is inputted to the gate of the MOS transistor Q34 and a control signal PGATE is outputted from its drain.

The driver circuit 38 of FIG. 6 is configured by a P channel MOS transistor Q39. The gate of the MOS transistor Q39 is coupled to the node N18, the source thereof is coupled to the source node VDD and the drain thereof is coupled to the node N11. The control signal PGATE is inputted to the gate of the MOS transistor Q39, and the internal source voltage VINT is outputted from the drain thereof.

The clamp circuit 34*a* of FIG. 6 includes P channel MOS transistors Q36 and Q37 coupled in series between the source node VDD and a node N19, an N channel MOS transistor Q38 coupled between the node N19 and the ground node Vss, and a capacitive element C1 coupled between the node N19 and the node N13. The gate of the MOS transistor Q36 is coupled to the node N15, and the gate of the MOS transistor Q37 is coupled to the node N16. The bias voltage BIAS4 is applied to the gate of the MOS transistor Q37. The MOS transistor Q38 configures a diode element by coupling of its gate and drain.

The operation of the clamp circuit 34*a* configured in this way is as follows: When the internal source voltage VINT is abruptly reduced due to a sudden increase in the current consumption of each load circuit, the voltage of the signal VINTD outputted from the preamplifier circuit 32*a* increases abruptly. With a rise in the potential of the node N13 at this time, the potential of the node N19 coupled via the capacitive element C1 also rises. When, however, the potential of the node N19 rises, the current that flows through the diode-coupled MOS transistor Q38 increases in a stroke. As a result, the potential of the node N13 is limited to less than or equal to a given value.

The operation of the above regulator circuit 30*a* shown in FIG. 6 will next be explained in contradistinction to comparative examples 1 and 2.

Figure 7:
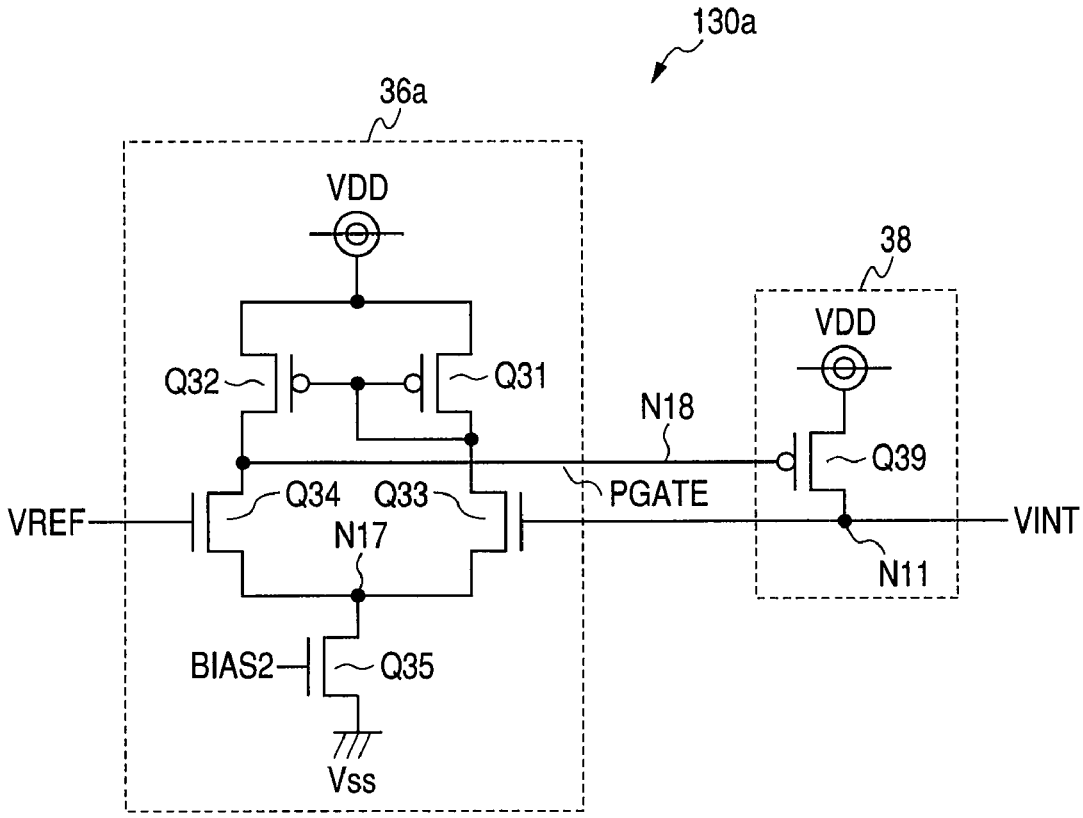
FIG. 7 is a circuit diagram illustrating a configuration of a regulator circuit 130*a* as a comparative example 1 of the regulator circuit 30*a* shown in FIG. 6.

FIG. 7 is a circuit diagram showing a configuration of a regulator circuit 130*a* as the comparative example 1 of the regulator circuit 30*a* shown in FIG. 6. The regulator circuit 130*a* shown in FIG. 7 is equivalent to one in which the preamplifier 32*a* and the clamp circuit 34*a* have been eliminated from the regulator circuit 30*a* of FIG. 6. In FIG. 7, the gate of a MOS transistor Q33 is coupled to a node N11. An internal source voltage VINT is inputted to the gate of the MOS transistor Q33. Further, a reference voltage VREF is inputted to the gate of the MOS transistor Q33 shown in FIG. 7.

Figure 8:
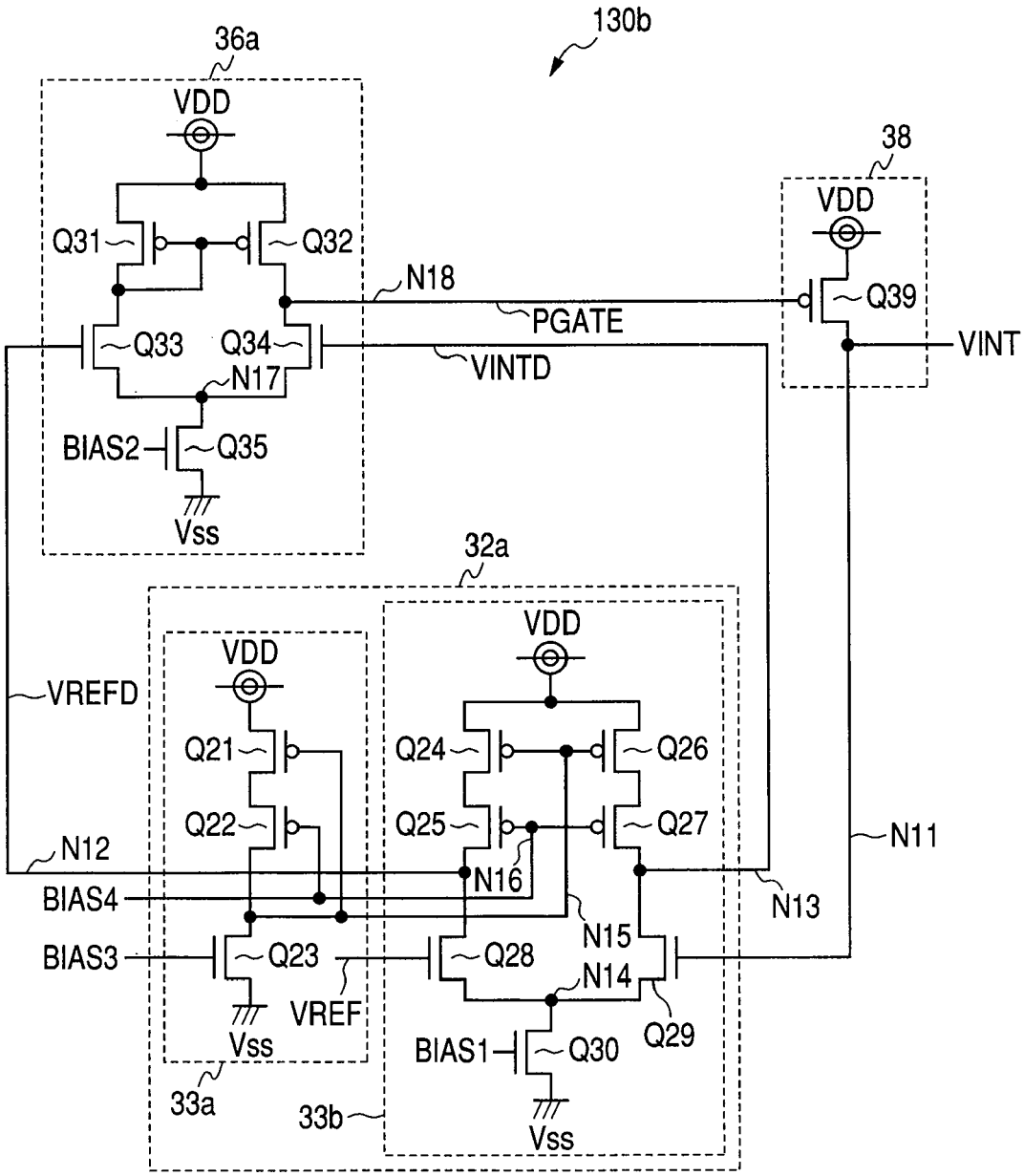
FIG. 8 is a circuit diagram showing a configuration of a regulator circuit 130*b* as a comparative example 2 of the regulator circuit 30*a* shown in FIG. 6.

FIG. 8 is a circuit diagram showing a configuration of a regulator circuit 130*b* as the comparative example 2 of the regulator circuit 30*a* of FIG. 6. The regulator circuit 130*b* shown in FIG. 8 is equivalent to one in which the clamp circuit 34*a* has been eliminated from the regulator circuit 30*b* shown in FIG. 6. Since the regulator circuit 130*b* of FIG. 8 is similar to the regulator circuit 30*a* of FIG. 6 in other configuration, the description thereof will not be repeated.

Figure 9:
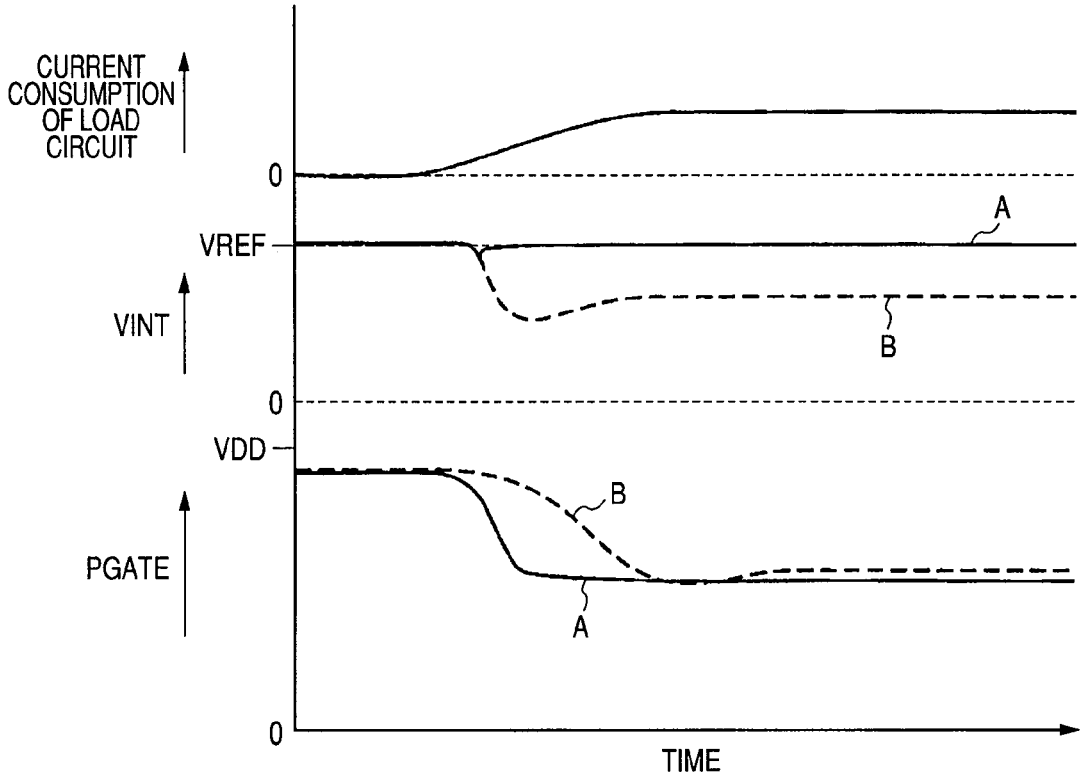
FIG. 9 is a graph showing voltage waveforms of the regulator circuits 30*a* and 130*a* shown in FIGS. 6 and 7 where current consumption of each load circuit increases gently.

FIG. 9 is a graph showing voltage waveforms of the regulator circuits 30*a* and 130*a* shown in FIGS. 6 and 7 where current consumption of each load circuit increases gently. In FIG. 9, the horizontal axis indicates time and the vertical axis indicates simulation waveforms of the current consumption of each load circuit, the internal source voltage VINT and the control voltage PGATE in order from above. A solid line A in FIG. 9 indicates a signal waveform of the regulator circuit 30*a* of FIG. 6, and a broken line B indicates a signal waveform of the regulator circuit 130*a* shown in FIG. 7.

FIG. 9 shows the case in which the current consumption increases slowly and the internal source voltage VINT is reduced. In the regulator circuit 130*a* (broken line B) of FIG. 7 in this case, the main amplifier circuit 36*a* does not respond unless the internal source voltage VINT is reduced until it exceeds the input sensitivity (20 mV, for example) of the main amplifier circuit 36*a*. On the other hand, in the regulator circuit 30*a* (solid line A) of FIG. 6, the preamplifier circuit 32*a* and the main amplifier circuit 36*a* are operated at high sensitivity and high speed only with a slight reduction in the internal source voltage VINT. As a result, the regulator circuit 30*a* (solid line A) of FIG. 6 is recovered to a stable point (reduction of 0.1 mV) promptly although a reduction in the internal source voltage VINT occurs.

Figure 10:
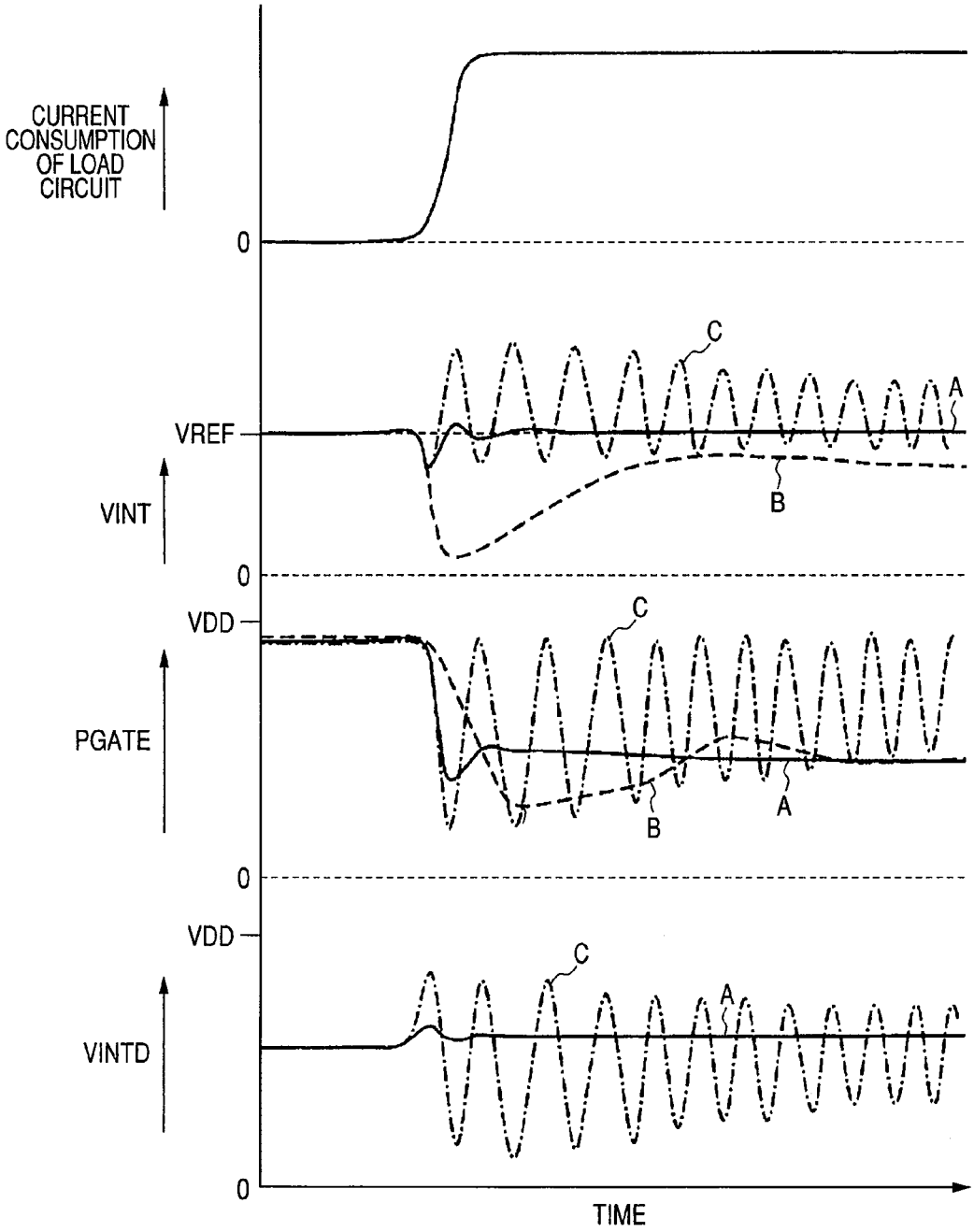
FIG. 10 is a graph showing voltage waveforms of the regulator circuits 30*a*, 130*a* and 130*b* shown in FIGS. 6 through 8 where current consumption of each load circuit increases suddenly.

FIG. 10 is a graph showing voltage waveforms of the regulator circuits 30*a*, 130*a* and 130*b* shown in FIGS. 6 through 8 where current consumption of each load circuit increases abruptly. In FIG. 10, the horizontal axis indicates time and the vertical axis indicates simulation waveforms of the current consumption of each load circuit, the internal source voltage VINT, the control voltage PGATE and the output voltage VINTD in order from above. A solid line A in FIG. 10 indicates a signal waveform of the regulator circuit 30*a* of FIG. 6, a broken line B indicates a signal waveform of the regulator circuit 130*a* shown in FIG. 7, and a one-dot chain line C indicates a signal waveform of the regulator circuit 130*b* of FIG. 8.

Referring to FIG. 10, when the current consumption of the load circuit is of a large current and increases abruptly, the regulator circuit 130*a* (broken line B in FIG. 10) of FIG. 7 cannot adapt to its abrupt change for a while and thereby causes a large drop in the internal source voltage VINT. After a slight time interval has elapsed, the internal source voltage VINT is recovered to a stable point (a reduction of 20 mV, for example).

On the other hand, since the clamp circuit 34*a* is not provided in the regulator circuit 130*b* (one-dot chain line C in FIG. 10) of FIG. 8, the preamplifier circuit 32*a* that responds to the abrupt reduction in the internal source voltage VINT first changes the output voltage VINTD greatly. Since the output voltage VINTD of the preamplifier circuit 32*a* fluctuates greatly, the next-stage main amplifier circuit 36*a* falls outside a saturated region operation and deviates therefrom significantly. Overcharging is performed on each load circuit more than necessary originally through the final-stage driver circuit 38. Thus, an abrupt rise in the internal source voltage VINT occurs, and its result is next fed back, so that the preamplifier circuit 32*a* operates so as to stop charging abruptly. Thus, the supply of power from the driver circuit 38 next falls short. As a result, oscillating operations occur as indicated by the one-dot chain lines C of FIG. 10.

In the regulator circuit 30*a* (solid line A in FIG. 10) of FIG. 6, the clamp circuit 34*a* prevents the oscillating operations from occurring. That is, even though the output voltage VINTD of the preamplifier circuit 32*a* tries to vary greatly due to the abrupt reduction in the internal source voltage VINT, the output voltage VINTD is clamped momentarily under the operations of the capacitive element C1 of the clamp circuit 34*a* and the diode (diode-connected MOS transistor Q38), so that the amplitude of the output voltage VINTD is limited. With the operation of such a clamp circuit 34*a*, the preamplifier circuit 32*a* maintains a high-sensitive operation with respect to a small change in the internal source voltage VINT and can protect against supersaturation of the next-stage main amplifier circuit 36*a* where the internal source voltage VINT changes greatly.

According to the regulator circuits 30 and 30*a* of the first preferred embodiment of the present invention as described above, a high-sensitive internal voltage generator can be realized which lessens a reduction in the internal source voltage VINT even with respect to the gentle current consumption and the sudden large current consumption.

Second Preferred Embodiment

Figure 11:
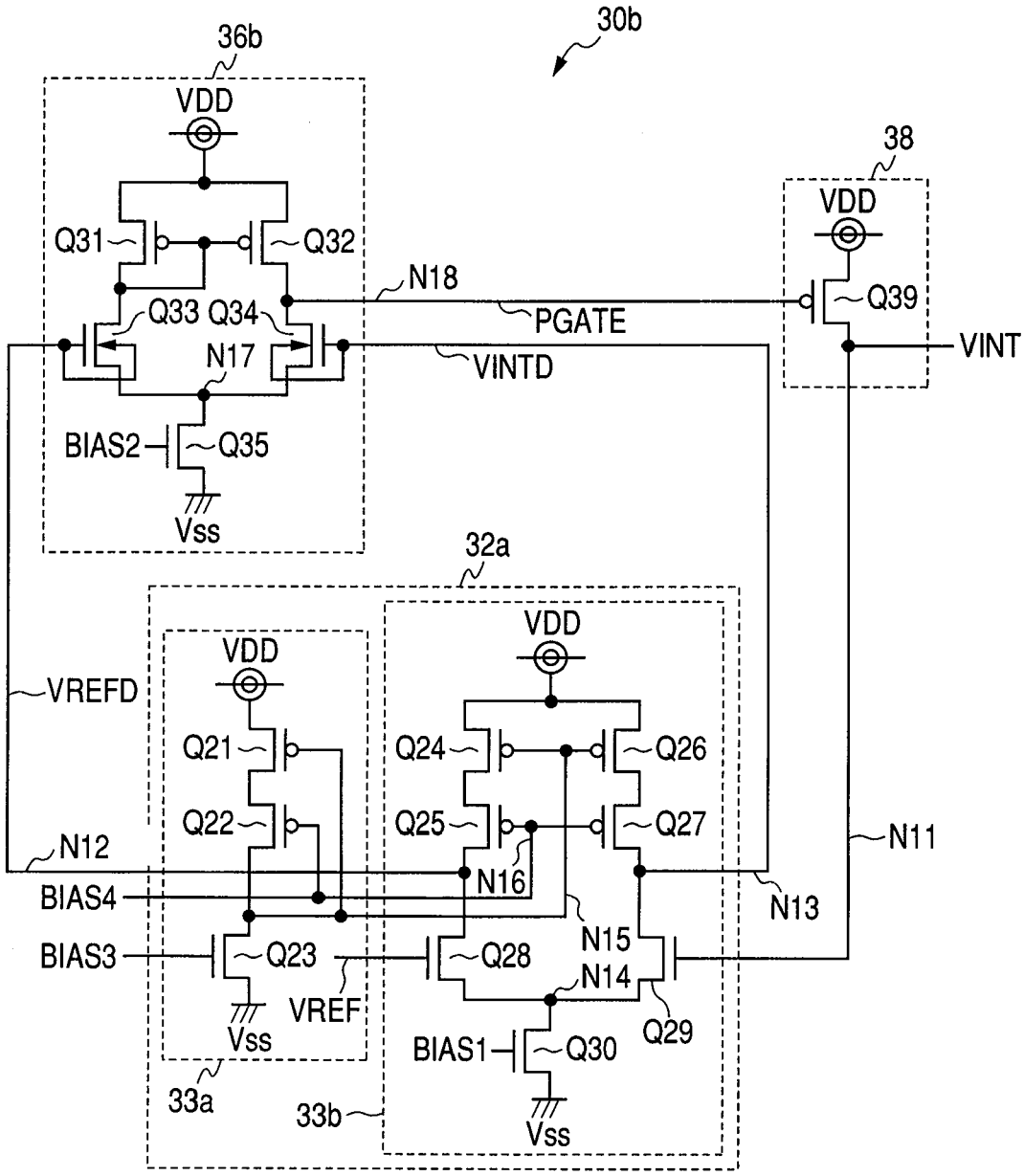
FIG. 11 is a circuit diagram illustrating a configuration of a regulator circuit 30*b* as a second preferred embodiment of the present invention.

FIG. 11 is a circuit diagram showing a configuration of a regulator circuit 30*b* as a second preferred embodiment of the present invention. Referring to FIG. 11, the regulator circuit 30*b* of the second preferred embodiment is different from the regulator circuit 30*a* of FIG. 6 in that the clamp circuit 34*a* of FIG. 6 is not provided. Further, the regulator circuit 30*b* has a main amplifier circuit 36*b* in which the gates of N channel MOS transistors Q33 and Q34 and their bodies (back gates) are coupled, in place of the main amplifier circuit 36*a* of FIG. 6. Since other configurations shown in FIG. 11 are similar to those shown in FIG. 6, their explanations will not be repeated. Incidentally, the gates and bodies of both MOS transistors Q33 and Q34 are coupled for the reason that the characteristics of the MOS transistors Q33 and Q34 used as a differential pair are made equal to each other.

Figure 12:
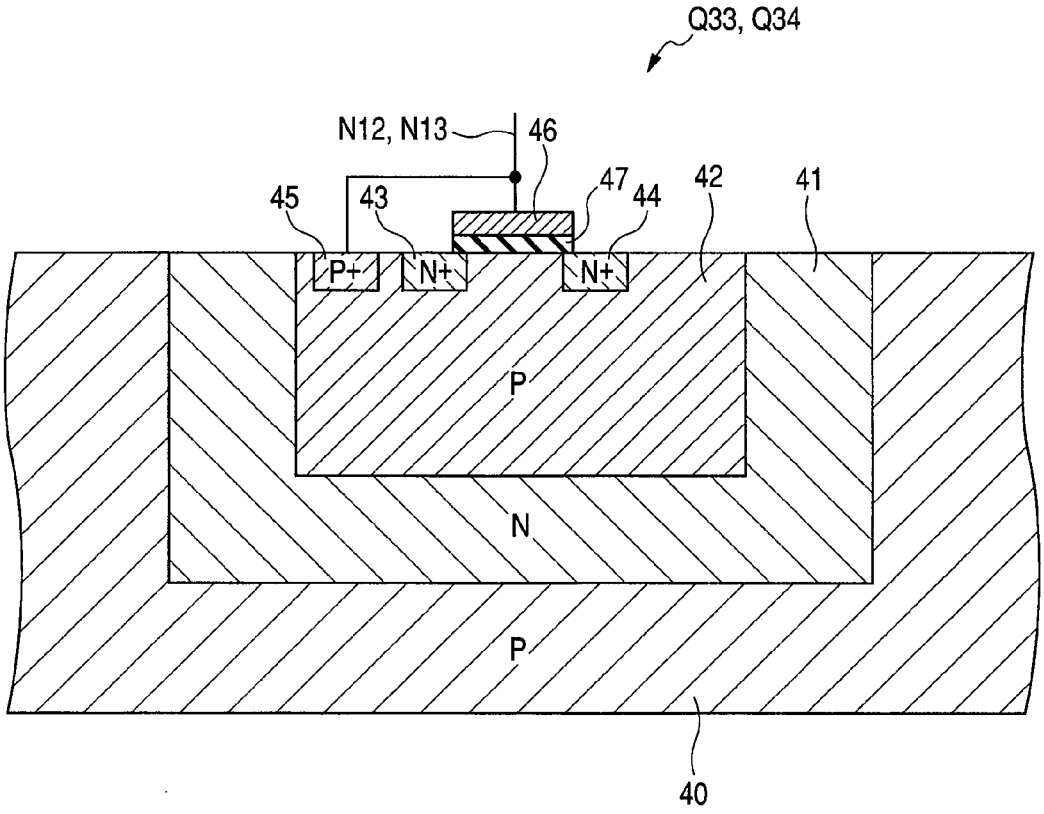
FIG. 12 is a sectional view depicting a structure of MOS transistors Q33 and Q34 shown in FIG. 11.

FIG. 12 is a sectional view showing a structure of the MOS transistors Q33 and Q34 shown in FIG. 11. In FIG. 12, an N well 41 is provided in a P-type substrate 40, and a P well 42 is provided inside the N well 41. The N channel MOS transistors Q33 and Q34 are provided in a region of the P well 42 electrically isolated from the base substrate in this way.

Referring to FIG. 12, the N channel MOS transistors Q33 and Q34 respectively include source and drain regions 43 and 44 doped to achieve an N type, a channel region provided between the source and drain regions 43 and 44, a gate 46 provided opposite to the channel region with a gate insulating film 47 interposed therebetween, and a region 45 that contacts with the P well 42. The gate 46 and the contact region 45 are electrically couple to each other.

Referring to FIGS. 11 and 12, a positive electric charge injected into the gate 46 of the MOS transistor Q34 is transferred to the back gate side (P well 42) of the MOS transistor Q34 as it is where an output voltage VINTD of a preamplifier circuit 32*a* increases excessively with an abrupt increase in the current consumption of an internal circuit. The injected electric charge is discharged to a node N17 via a PN junction configured by the P well 42 and the source 43. At this time, a voltage greater than or equal to a threshold voltage α of the MOS transistor Q34 is not applied between the gate 46 and source 43 of the N channel MOS transistor Q34. The threshold voltage α is of a value determined depending on a trade-off between the amount of electric charge Qin supplied from the preamplifier circuit 32*a* and the amount of electric charge Qout discharged to a ground node Vss via the PN junction.

Since the amount of electric charge Qin supplied from the preamplifier circuit 32*a* depends on the gate capacitance and parasitic capacitance of the MOS transistor Q34 here, it is proportional to the output voltage VINTD. On the other hand, the amount of electric charge Qout discharged to the ground node Vss via the PN junction is proportional to exp (VINTD). Thus, the more the preamplifier circuit 32*a* outputs a large output voltage VINTD, the larger the effect of discharging the electric charge. As a result, a voltage clamp effect becomes larger. On the other hand, when the main amplifier circuit 36*b* detects a weak output voltage VINTD, no clamp effect is produced and the detection of a high-precision output voltage VINTD is enabled.

Thus, the regulator circuit 30*b* of the second preferred embodiment is capable of performing voltage clamp efficiently as compared with the first preferred embodiment by mounting the main amplifier circuit 36*b* capable of automatically adjusting each voltage value inputted thereto. The regulator circuit 30*b* can be reduced in area as compared with the regulator circuit 30*a* of the first preferred embodiment provided with the capacitive element C1. As a result, the chip area of a semiconductor integrated circuit device can be reduced and its manufacturing cost can also be cut down.

Third Preferred Embodiment

A third preferred embodiment of the present invention provides a regulator circuit 30*c* having a structure suitable for an SOI (Silicon on insulator) substrate.

Figure 13:
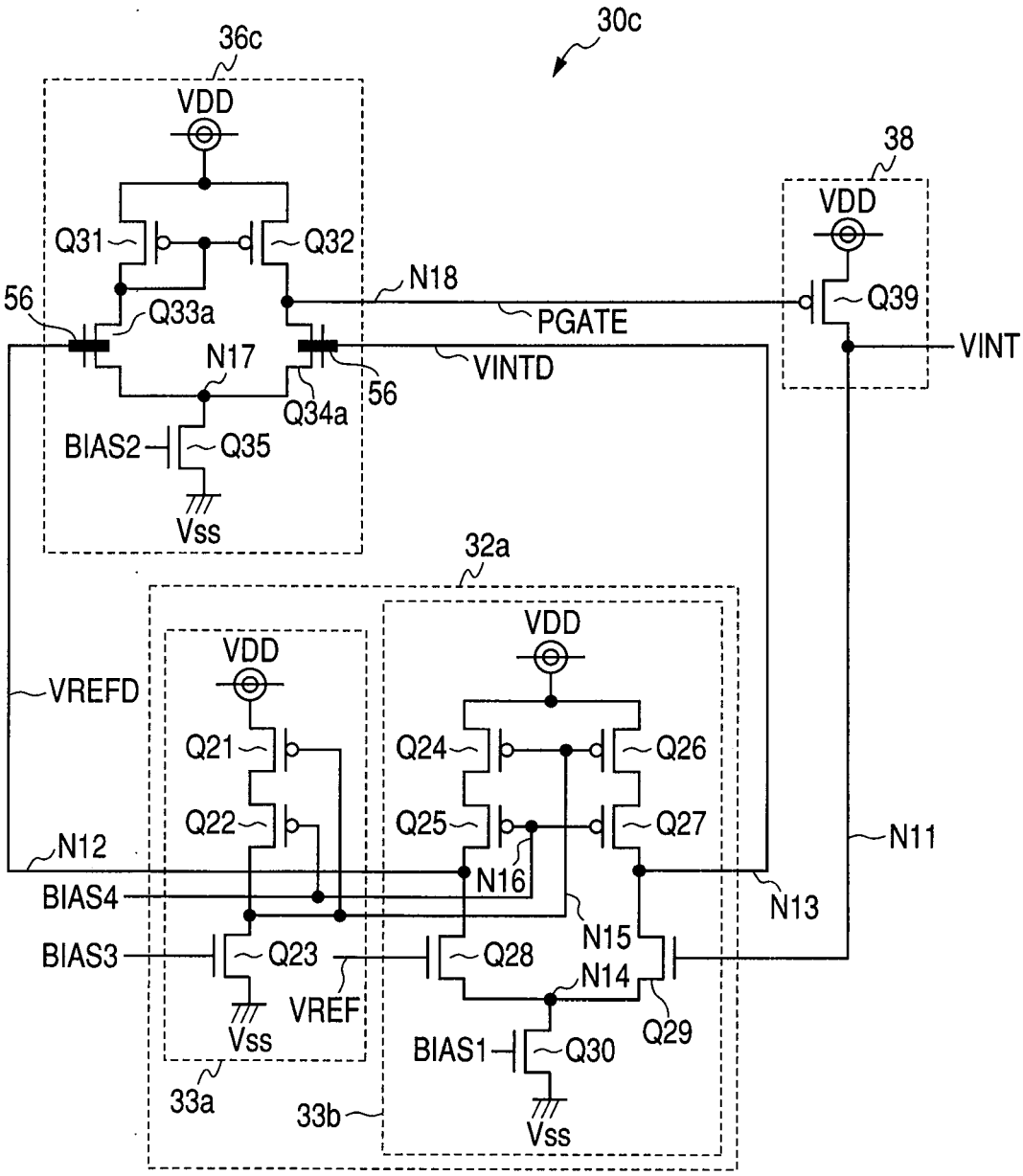
FIG. 13 is a circuit diagram showing a configuration of a regulator circuit 30*c* as a third embodiment of the present invention.

FIG. 13 is a circuit diagram showing a configuration of the regulator circuit 30*c* as the third preferred embodiment of the present invention. The regulator circuit 30*c* shown in FIG. 13 is different from that of FIG. 11 in that MOS transistors Q33*a* and Q34*a* each having a gate-body directly-coupled portion 56 are used in place of the N channel MOS transistors Q33 and Q34 of the main amplifier circuit 36*b* shown in FIG. 11. Since other configurations in FIG. 13 are similar to those in FIG. 11, their explanations will not be repeated.

Figure 14:
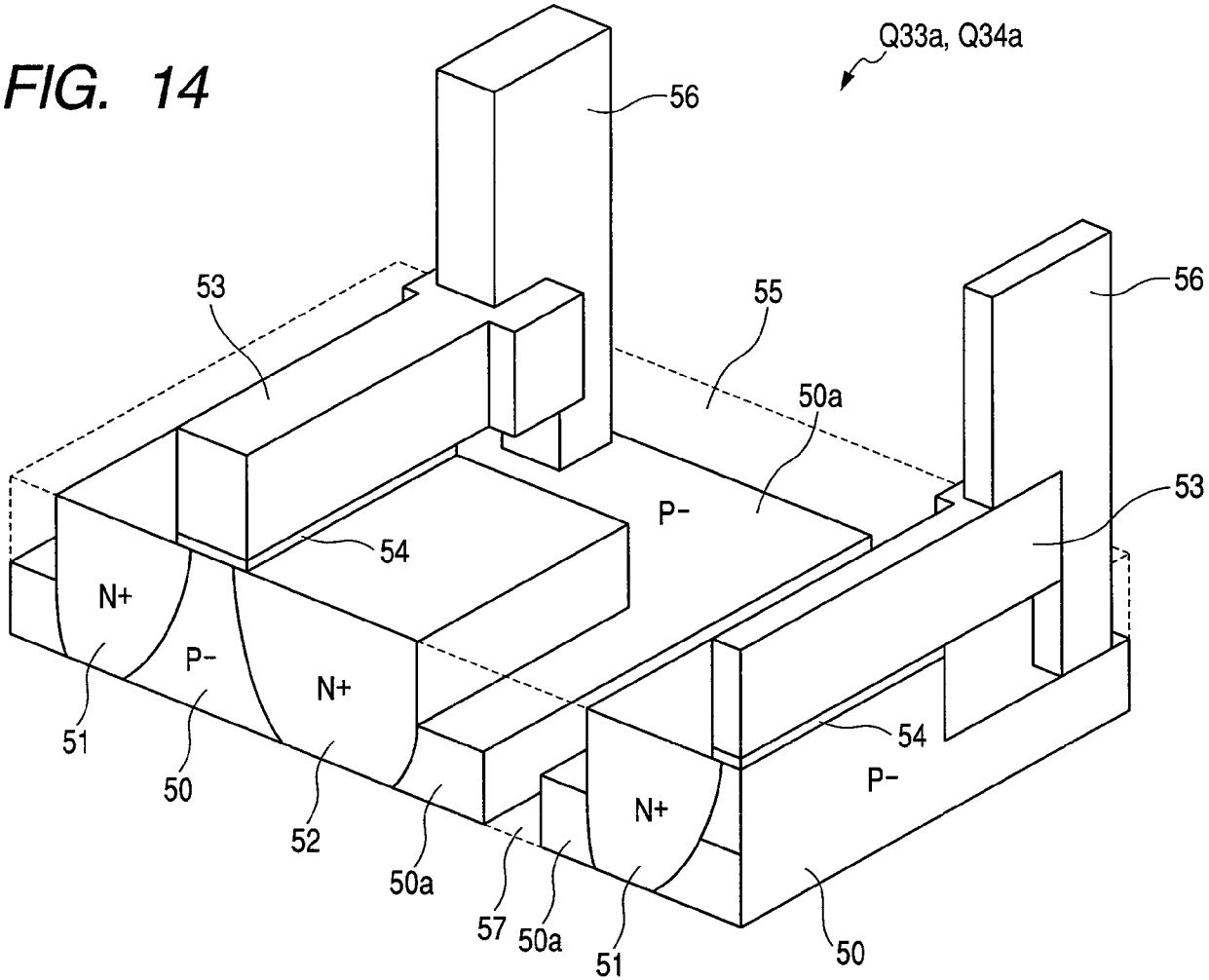
FIG. 14 is a perspective view typically showing a structure of MOS transistors Q33*a* and Q34*a* shown in FIG. 13.
Figure 15:
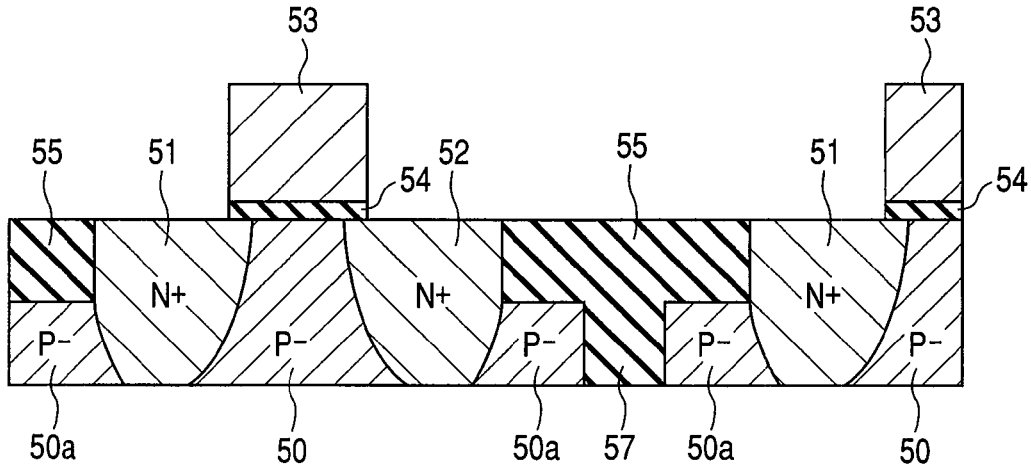
FIG. 15 is a sectional view illustrating the structure of the MOS transistors Q33*a* and Q34*a* where
Figure 16:
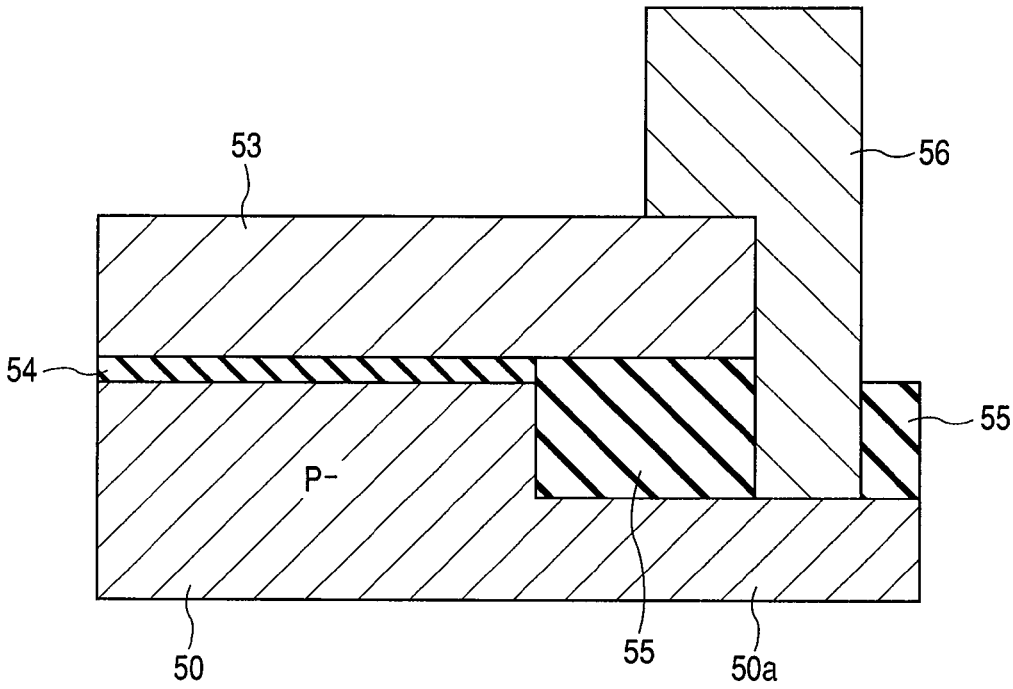
FIG. 16 is a sectional view showing the structure of the MOS transistors Q33*a* and Q34*a* where

FIG. 14 is a perspective view typically showing a structure of the MOS transistors Q33*a* and Q34*a* shown in FIG. 13. FIG. 15 is a sectional view showing the structure of the MOS transistors Q33*a* and Q34*a* where FIG. 14 is front-viewed. FIG. 16 is a sectional view showing the structure of the MOS transistors Q33*a* and Q34*a* where FIG. 14 is side-viewed.

Referring to FIGS. 14 through 16, the MOS transistors Q33*a* and Q34*a* are respectively formed over an unillustrated SOI substrate and include P-type body regions 50, N-type source and drain regions 51 and 52, and gates 53 comprised of polysilicon provided via a gate insulating film 54. The MOS transistors Q33*a* and Q34*a* respectively have extensions 50*a* of the body regions 50 called "partial isolation". A region 57 provided between the extension 50*a* of the body region 50 and the extension 50*a* of the MOS transistor adjacent thereto is perfectly isolated by an insulating film 55 comprised of silicon dioxide. The gate-body directly-coupled portion 56 is provided between the gate 53 and the extension 50*a* and electrically couples the two.

Figure 17:
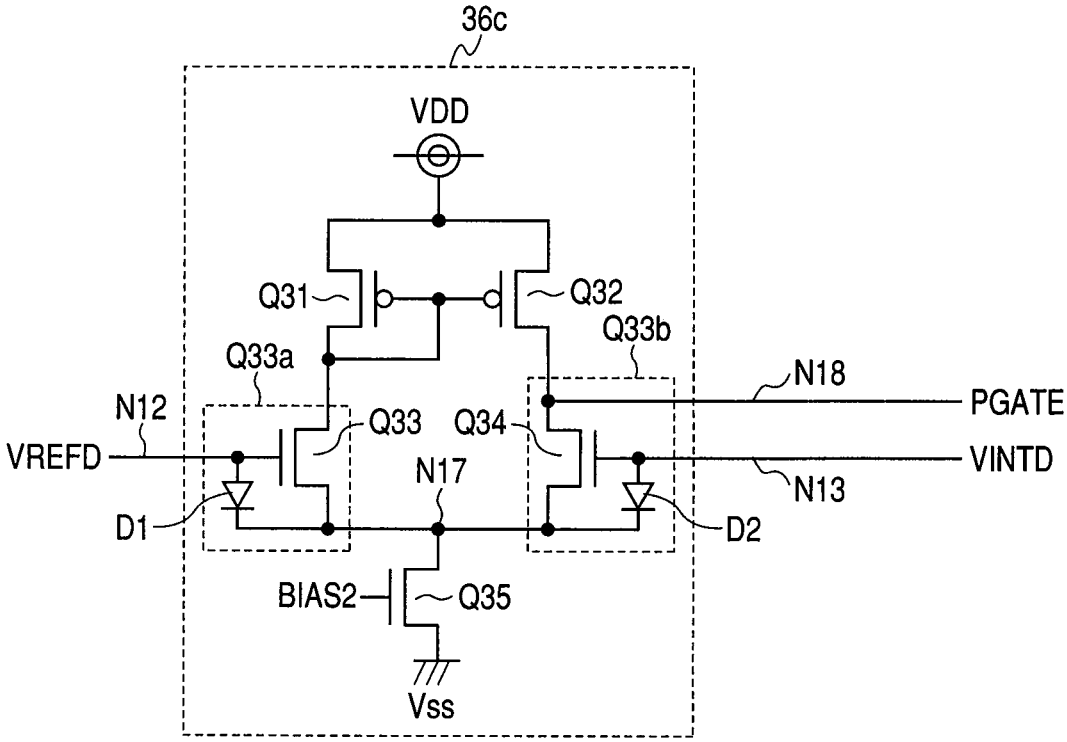
FIG. 17 is an equivalent circuit of a main amplifier circuit 36*c* shown in FIG. 13.

FIG. 17 is an equivalent circuit diagram of a main amplifier circuit 36*c* shown in FIG. 13. Referring to FIG. 17, the MOS transistors Q33*a* and Q34*a* each having the gate-body directly-coupled portion 56 shown in FIGS. 13 through 16 are respectively equivalent to configurations in which forward-coupled diodes D1 and D2 are respectively added between the gates and sources of the MOS transistors Q33 and Q34. PN junctions that configure the diodes D1 and D2 are respectively formed by the P-type body regions 50 and the N-type source regions 51 shown in FIGS. 14 through 16.

The regulator circuit 30*b* of the second preferred embodiment shown in FIG. 12 needed the isolation of the P well 42 (back gate) to directly the gate and the body. Therefore, in the second preferred embodiment, degradation in noise stability occurs and a spare area was required for well-based isolation. On the other hand, the regulator circuit 30*c* of the third preferred embodiment has been designed to reduce an area penalty and the influence of noise to the utmost by taking advantage of the characteristic of an SOI structure and using the MOS transistors each having the gate-body directly-coupled portion 56. Since a substrate is originally isolated by an insulating layer in the SOI structure, the SOI structure needs not to isolate a well. Further, the gate and body in a transistor single-body level can be directly coupled to each other by using a partial separation system in which a P-type semiconductor layer is left at a back gate thinly. Thus, in the third preferred embodiment, a low-noise regulator circuit 30*c* of a bulk device or greater can be realized by adopting a circuit configuration that takes advantage of the characteristic of the SOI structure.

Fourth Preferred Embodiment

Figure 18:
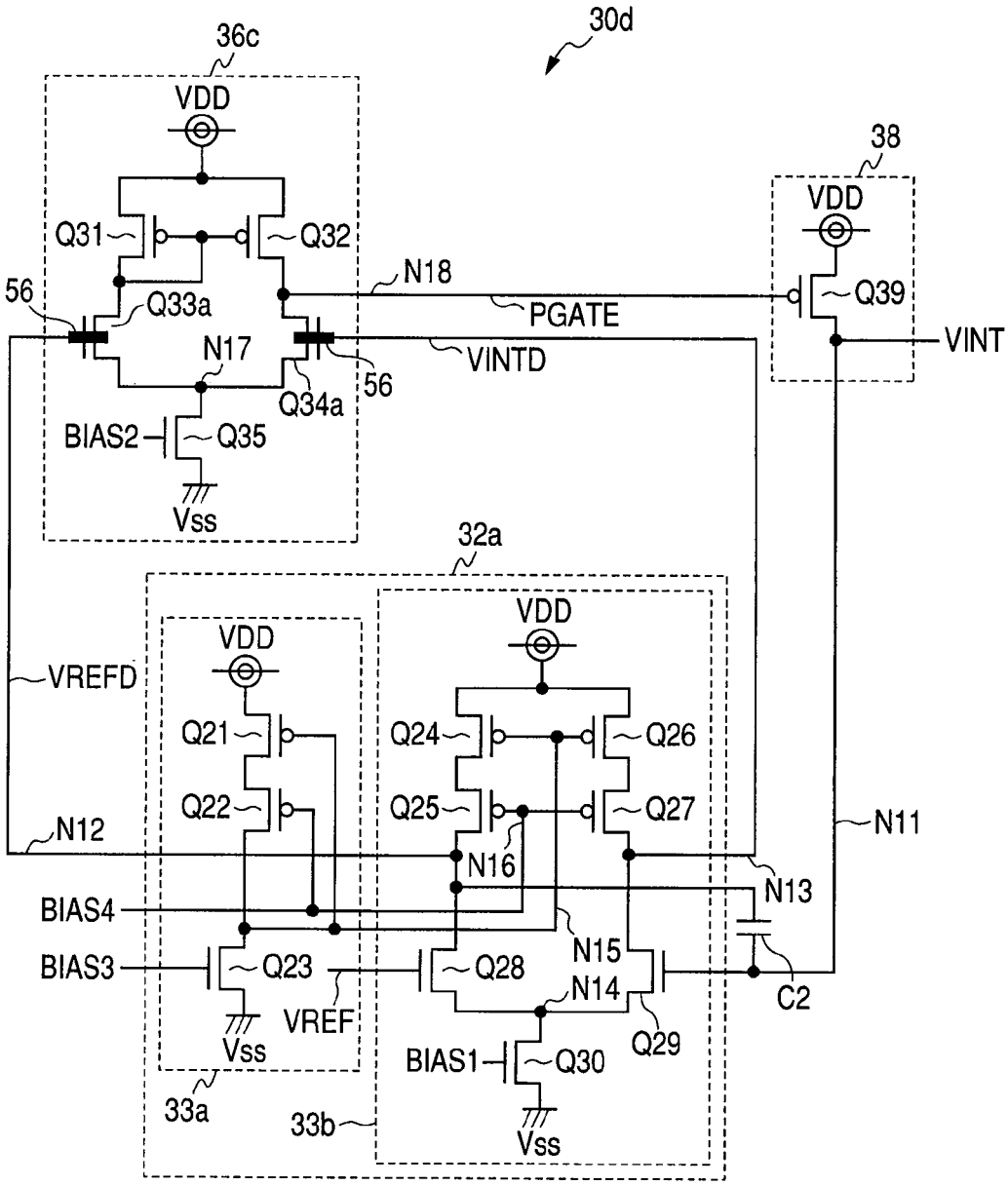
FIG. 18 is a circuit diagram illustrating a configuration of a regular circuit 30*d* as a fourth preferred embodiment of the present invention.

FIG. 18 is a circuit diagram showing a configuration of a regulator circuit 30*d* as a fourth preferred embodiment of the present invention. The regulator circuit 30*d* shown in FIG. 18 is different from the regulator circuit 30*c* shown in FIG. 13 in that a capacitive element C2 is further provided between a node N11 inputted with an internal source voltage VINT and a node N12 from which a signal being in phase with the internal source voltage VINT is outputted. Since other configurations shown in FIG. 18 are similar to FIGS. 6, 11 and 13, their explanations will not be repeated.

Here, the capacitive element C2 can also be provided between the node N11 and the node N12 of each of the regulator circuit 30*a* of FIG. 6 and the regulator circuit 30*b* of FIG. 11. FIG. 18 shows the regulator circuit 30*c* shown in FIG. 13 as a typical example.

Referring to FIG. 18, the capacitive value of the capacitive element C2 is of a capacitive value of such a degree that it is negligible as compared with the total capacitance of the load circuits coupled to the regulator circuit 30*d*. The capacitive element C2 is inserted for speeding-up and operational stability of the regulator circuit 30*d*.

In the regulator circuit 30*c* of FIG. 13 with no use of the capacitive element C2, the preamplifier circuit 32*a* actually starts operating after the detection of a change in current flowing through the corresponding differential amplifying section 33*b* where the internal source voltage VINT is reduced due to an increase in current consumption of each load circuit. Therefore, the response time of each transistor element is unavoidably added as a system's response delay time.

On the other hand, as shown in FIG. 18, a reduction in the internal source voltage VINT can directly be transferred to the output of the preamplifier circuit 32*a* as capacitive coupling of the capacitive element C2 by inserting the capacitive element C2 in parallel between the input and output terminals of the first-stage preamplifier circuit 32*a* in the amplifiers of two-stage amplification. Since the capacitive coupling is performed instantaneously, it can practically respond at high speed without making a delay corresponding to one stage of the preamplifier circuit 32*a*. Further, even when a large reduction in voltage, which causes oversaturation, occurs in the internal source voltage VINT, a steep change in output voltage VINTD of the preamplifier circuit 32*a* can be limited transiently via the capacitive element C2. As a result, the regulator circuit 30*d* of the fourth preferred embodiment also has the effect of reducing system's oscillations in conjunction with the above.

The preferred embodiments disclosed this time should be considered to be illustrative and not to be limitive in all respects. The scope of the present invention is indicated by the claims without by the above description and intended to cover the meaning equivalent to the claims and all changes within the scope thereof.

What is claimed is:

1. A semiconductor integrated circuit device comprising:

load circuits; and internal voltage generators for generating internal source voltages for driving the load circuits, wherein each of the internal voltage generators includes a reference voltage generating circuit for generating reference voltages, and regulator circuits for generating the internal source voltages with reference to the reference voltages, wherein the regulator circuit is formed over an SOI substrate and includes a preamplifier circuit for detecting and amplifying a difference between each of the internal source voltages and each of the reference voltages, a main amplifier circuit for amplifying the output of the preamplifier circuit and generating a control signal, and a driver circuit for generating the internal source voltage in response to the control signal, and wherein an input stage of the main amplifier circuit is configured by MOS transistors coupling the gates and bodies of the MOS transistors.

2. The semiconductor integrated circuit device according to any one of claims 1, wherein the gain of the preamplifier circuit is larger than that of the main amplifier circuit.

3. The semiconductor integrated circuit device according to any one of claims 2, wherein the preamplifier circuit includes a cascode-type differential amplifier circuit.

* * * * *